US006897369B1

(12) United States Patent
Lace

(10) Patent No.: US 6,897,369 B1
(45) Date of Patent: May 24, 2005

(54) SENSOR ASSEMBLY FOR STRINGED MUSICAL INSTRUMENTS

(76) Inventor: Jeffrey J. Lace, 18779 Ashford La., Huntington Beach, CA (US) 92648

( * ) Notice: Subject to any disclaimer, the term of this patent is extended or adjusted under 35 U.S.C. 154(b) by 101 days.

(21) Appl. No.: 10/053,440

(22) Filed: Jan. 17, 2002

Related U.S. Application Data

(60) Provisional application No. 60/262,218, filed on Jan. 17, 2001.

(51) Int. Cl.[7] ..... G10H 3/14
(52) U.S. Cl. ..... 84/727
(58) Field of Search ..... 84/726–728

(56) References Cited

U.S. PATENT DOCUMENTS 3,992,972 A 11/1976 Rickard
4,010,334 A 3/1977 Demeter
4,050,341 A 9/1977 Underwood
4,096,780 A 6/1978 Dawson
4,145,944 A 3/1979 Helpinstill, II
4,184,399 A 1/1980 Zuniga (Continued)

*Primary Examiner*—Jeffrey W Donels
(74) *Attorney, Agent, or Firm*—Bliss McGlynn, P.C.

(57) ABSTRACT

A sensor assembly for a stringed musical instrument having a plurality of movable strings includes at least one blade adapted to be disposed adjacent the strings and at least one magnet disposed adjacent the at least one blade to generate a magnetic field through the at least one blade. The sensor assembly includes a primary winding disposed adjacent the at least one blade to create a primary current from a disruption in the magnetic field by the moveable strings. The primary current creates a primary electromagnetic flux. The sensor assembly also includes at least one secondary winding spaced from the primary winding and being magnetically coupled to the primary winding. The at least one secondary winding transforms the primary electromagnetic flux into a secondary current adapted to be passed out the stringed musical instrument.

19 Claims, 5 Drawing Sheets

U.S. PATENT DOCUMENTS 4,188,849 A 2/1980 Rickard
4,261,240 A 4/1981 Aaroe
4,364,295 A * 12/1982 Stich ..... 84/726
4,378,722 A 4/1983 Isakson
4,499,809 A 2/1985 Clevinger
4,545,278 A 10/1985 Gagon et al.
4,581,974 A 4/1986 Fender
4,581,975 A 4/1986 Fender
4,809,578 A 3/1989 Lace, Jr.
4,869,144 A 9/1989 Lieber
4,872,386 A 10/1989 Betticare
4,885,970 A 12/1989 Fender
4,911,054 A 3/1990 McClish
4,941,389 A 7/1990 Wendler
5,027,691 A 7/1991 Kennedy
5,111,728 A 5/1992 Blucher et al.
5,168,117 A 12/1992 Anderson
5,189,241 A 2/1993 Nakamura
5,200,569 A 4/1993 Moore
5,252,777 A 10/1993 Allen
5,290,968 A 3/1994 Mirigliano et al.
5,292,998 A 3/1994 Knapp
5,292,999 A 3/1994 Tumura
5,311,806 A 5/1994 Riboloff
5,376,754 A 12/1994 Stich
5,389,731 A 2/1995 Lace
5,391,831 A 2/1995 Lace
5,391,832 A 2/1995 Lace
5,399,802 A 3/1995 Blucher
5,401,900 A 3/1995 Lace
5,408,043 A 4/1995 Lace
5,422,432 A 6/1995 Lace
5,430,246 A 7/1995 Lace, Sr. et al.
5,438,158 A 8/1995 Riboloff
5,464,948 A 11/1995 Lace
5,484,958 A 1/1996 Ogawa
5,610,357 A * 3/1997 Frank-Braun ..... 84/726
5,641,932 A 6/1997 Lace
5,767,431 A 6/1998 Khanagov
5,792,973 A * 8/1998 Riboloff ..... 84/726
5,831,196 A 11/1998 Khanagov
5,945,622 A 8/1999 Yamada
6,043,422 A 3/2000 Chapman
6,111,184 A 8/2000 Cloud et al.
6,111,185 A 8/2000 Lace
6,162,984 A 12/2000 Engard
6,271,457 B1 8/2001 Hudak
6,605,771 B1 8/2003 Baggs

* cited by examiner

FIG 1
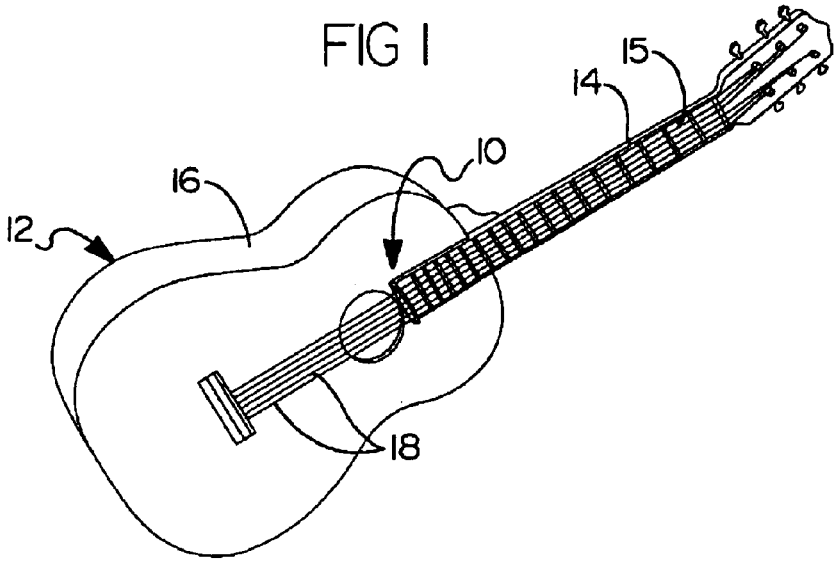
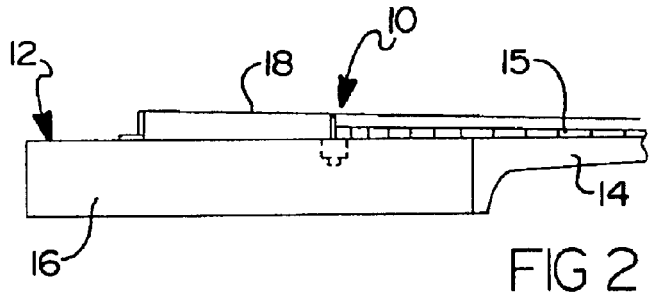
FIG 2
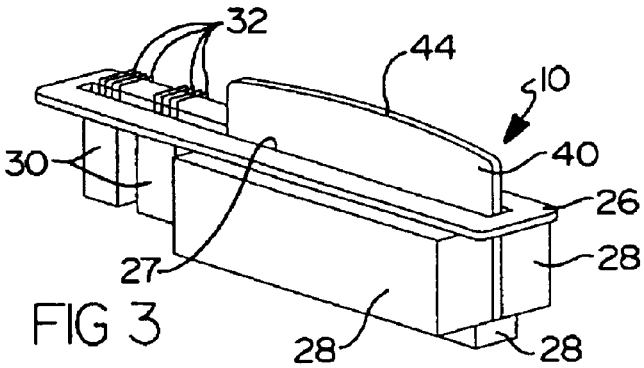
FIG 3
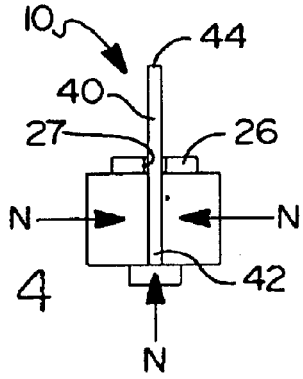
FIG 4

FIG 5
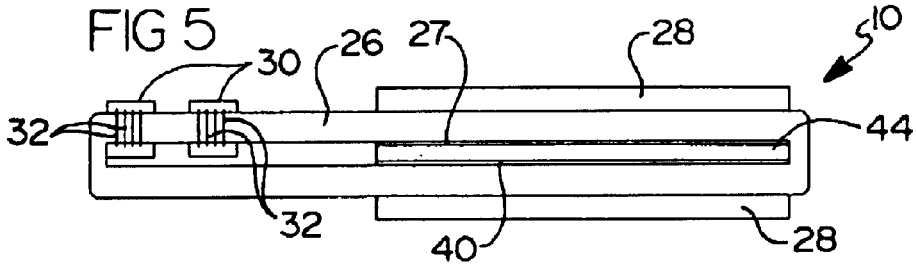
FIG 6
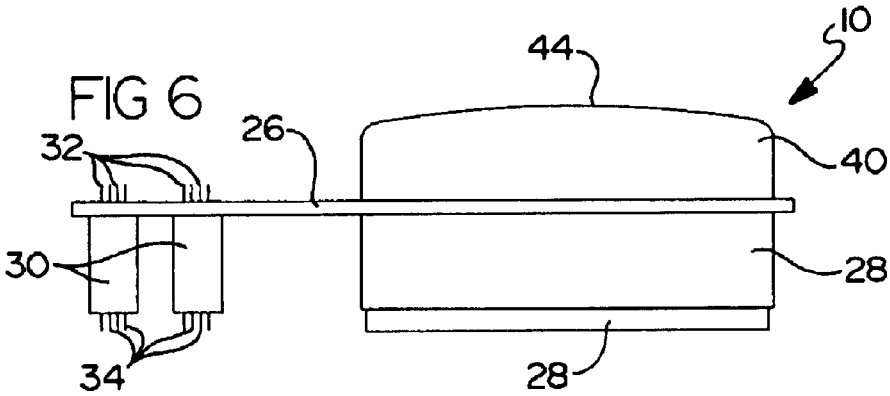
FIG 7
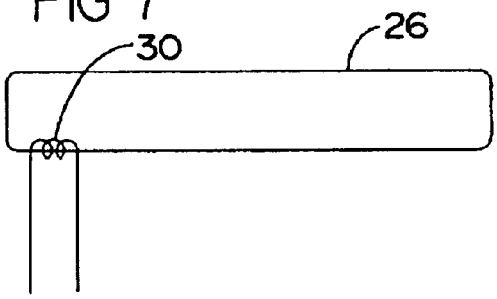
FIG 8
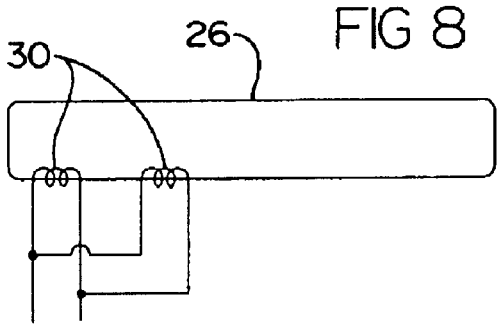
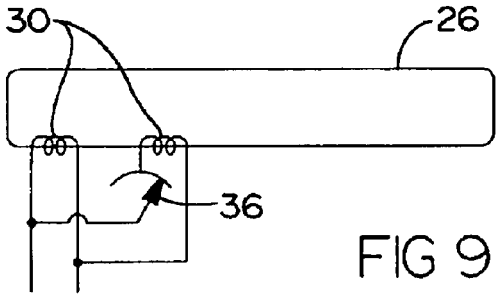
FIG 9

FIG 10
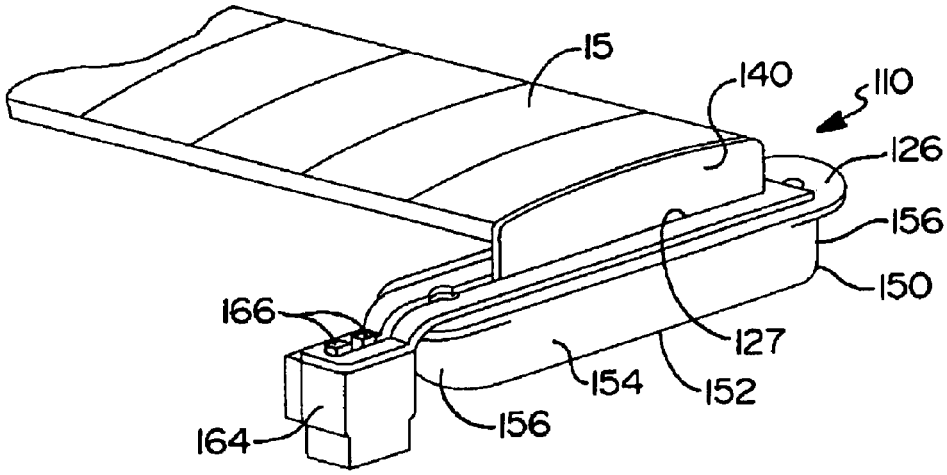
FIG 11
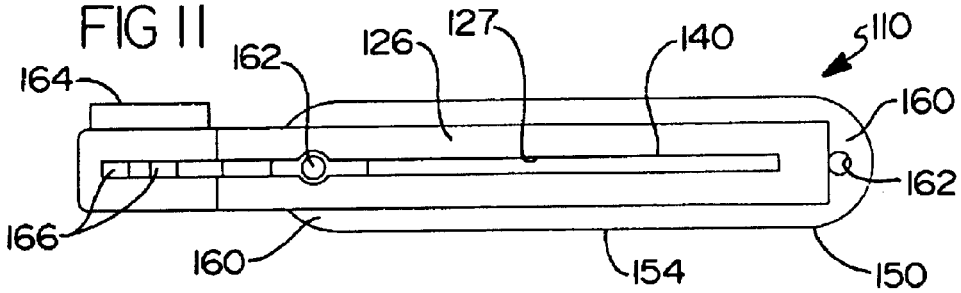
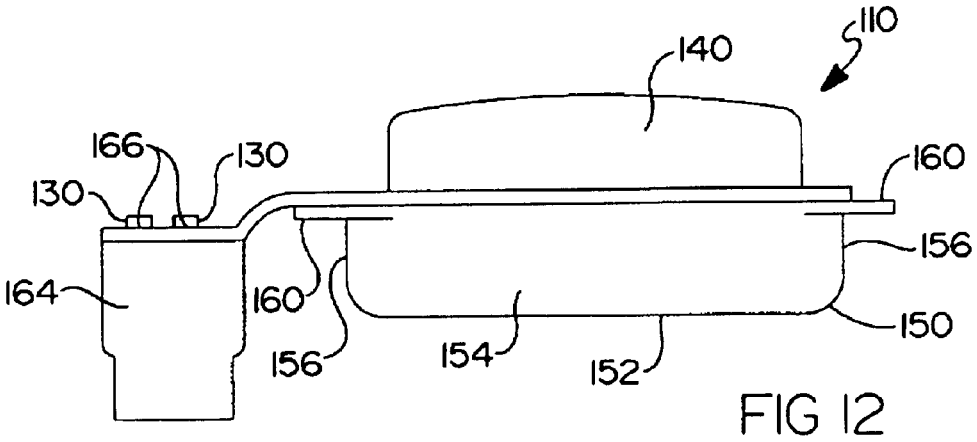
FIG 12

FIG 15
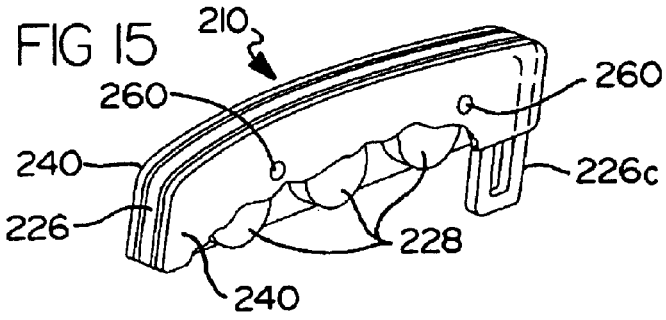
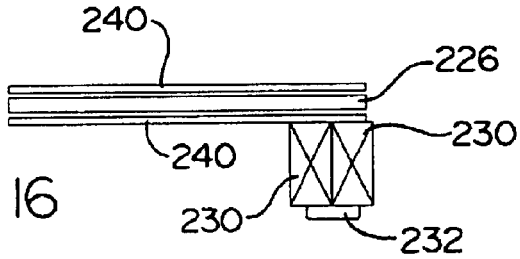
FIG 16
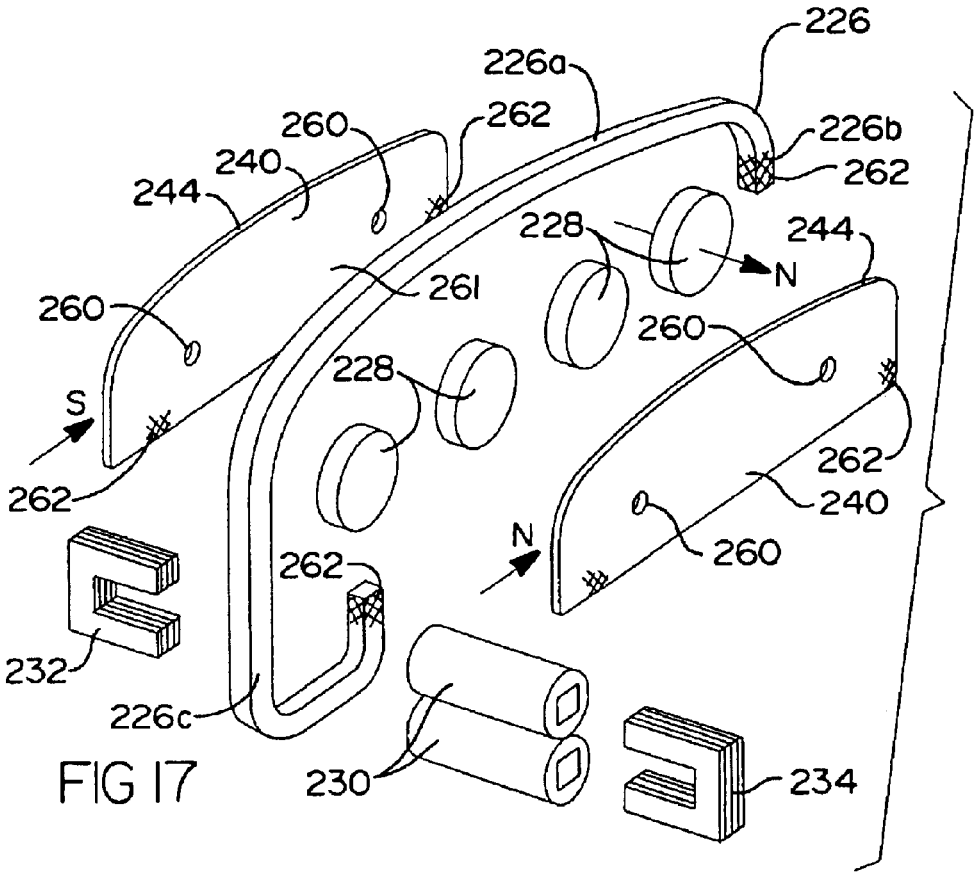
FIG 17

SENSOR ASSEMBLY FOR STRINGED MUSICAL INSTRUMENTS

CROSS-REFERENCE TO RELATED APPLICATION(S)

The present invention claims the priority date of copending U.S. Provisional Patent Application Serial No. 60/262,218, filed Jan. 17, 2001.

BACKGROUND OF THE INVENTION

1. Field of the Invention

The present invention relates generally to musical instruments and, more particularly, to a sensor assembly for use with stringed musical instruments.

2. Description of the Related Art

Generally, stringed musical instruments such as electric guitars have electromagnetic sensors or pick-ups for sensing mechanical vibrations of the strings and converting such into electrical signals. The electrical signals from the electromagnetic sensors are amplified and modified and, ultimately, reconverted into acoustical energy to produce music and the like.

U.S. Pat. Nos. 5,501,900 and 5,438,157, issued to Lace, discloses an acoustic electromagnetic sensor assembly and mounting assembly for a stringed musical instrument. In that patent, the sensor assembly has a mounting assembly which fits in a sound hole of the stringed musical instrument. These electromagnetic sensors have a high visual impact when mounted on a stringed musical instrument such as an acoustic guitar. Further, these electromagnetic sensors typically have a tone and output that has a single value.

It is desirable to provide a sensor assembly that has less of a visual impact. It is also desirable to provide a sensor assembly with more variations in tone and output. Therefore, there is a need in the art to provide a sensor assembly, which meets these desires.

SUMMARY OF THE INVENTION

It is, therefore, one object of the present invention to provide a sensor assembly for a stringed musical instrument.

It is another object of the present invention to provide an electromagnetic sensor for an acoustic stringed musical instrument that has a low visual impact.

It is a further object of the present invention to provide an electromagnetic sensor for an acoustic stringed musical instrument that provides flexibility in tone and output of the sensor.

To achieve the foregoing objects, the present invention is a sensor assembly for a stringed musical instrument having a plurality of movable strings. The sensor assembly includes at least one blade adapted to be disposed adjacent the strings and at least one magnet disposed adjacent the at least one blade to generate a magnetic field through the at least one blade. The sensor assembly includes a primary winding disposed adjacent the at least one blade to create a primary current from a disruption in the magnetic field by the moveable strings. The primary current creates a primary electromagnetic flux. The sensor assembly also includes at least one secondary winding spaced from the primary winding and being magnetically coupled to the primary winding. The at least one secondary winding transforms the primary electromagnetic flux into a secondary current adapted to be passed out the stringed musical instrument.

One advantage of the present invention is that a new sensor assembly is provided for a stringed musical instrument. Another advantage of the present invention is that a sensor assembly is provided for a stringed musical instrument, which has low impact visually on the instrument or is virtually invisible on the instrument. A further advantage of the present invention is that the sensor assembly provides flexibility in the tone and output of the sensor. Yet a further advantage of the present invention is that the sensor assembly is quieter via making a primary winding humbucking. Still a further advantage of the present invention is that the sensor assembly uses neodymium magnets to decrease the packaging size, making the assembly smaller, and more versatile in mounting. Another advantage of the present invention is that the sensor assembly has at least one blade to aesthetically blend into the neck of the stringed musical instrument such as a guitar. Yet another advantage of the present invention is that the sensor assembly has full humbucking primary and secondary windings. Still another advantage of the present invention is that the sensor assembly has greater sensitivity with a primary winding at the top of the blade. A further advantage of the present invention is that the sensor assembly is non-visually distracting and blends in with the end of the neck or can be in neck.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIG. 1 is a perspective view of a sensor assembly, according to the present invention, illustrated in operational relationship with a stringed musical instrument.

FIG. 2 is a side elevational view of the sensor assembly and stringed musical instrument of FIG. 1.

FIG. 3 is a perspective view of the sensor assembly of FIG. 1.

FIG. 4 is a side elevational view of the sensor assembly of FIG. 1.

FIG. 5 is a plan view of the sensor assembly of FIG. 1.

FIG. 6 is a front view of the sensor assembly of FIG. 1.

FIG. 7 is a schematic view of a single secondary winding for the sensor assembly of FIG. 1.

FIG. 8 is a schematic view of a dual secondary winding in parallel for the sensor assembly of FIG. 1.

FIG. 9 is a schematic view of a dual secondary winding with a potentiometer for the sensor assembly of FIG. 1.

FIG. 10 is a perspective view of another embodiment, according to the present invention, of the sensor assembly of FIG. 1 illustrated in operational relationship with a stringed musical instrument.

FIG. 11 is a plan view of the sensor assembly of FIG. 10.

FIG. 12 is a front view of the sensor assembly of FIG. 10.

FIG. 15 is a perspective view of the sensor assembly of FIG. 13 illustrated with the secondary windings removed.

FIG. 16 is a plan view of the sensor assembly of FIG. 13.

FIG. 17 is an exploded perspective view of the sensor assembly of FIG. 13.

DESCRIPTION OF THE PREFERRED EMBODIMENT(S)

Figure 13:
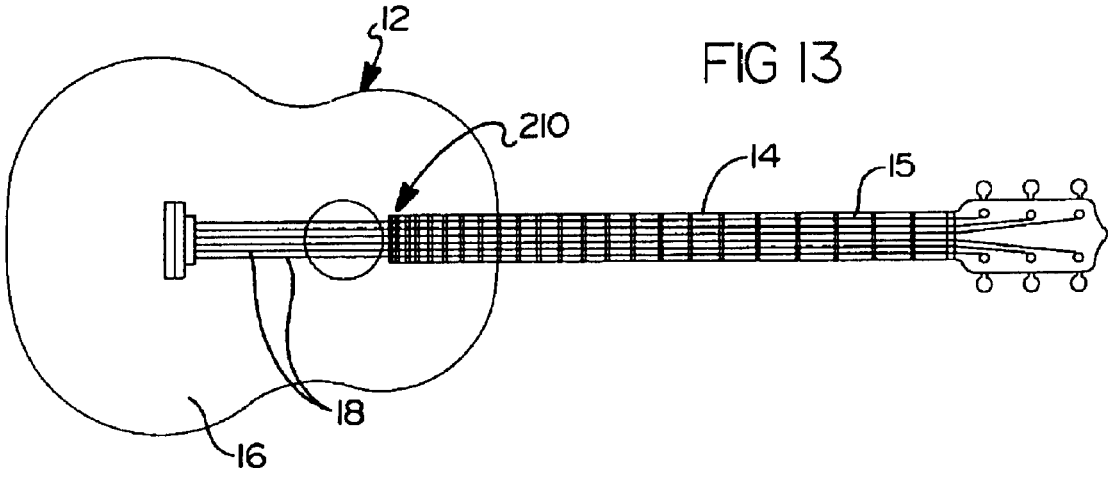
FIG. 13 is a plan view of yet another embodiment, according to the present invention, of the sensor assembly of FIG. 1 illustrated in operational relationship with a stringed musical instrument.

Referring to the drawings and, in particular, to FIGS. 1 and 2, one embodiment of a sensor assembly 10, according to the present invention, is illustrated in operational relationship with a stringed musical instrument, such as a guitar, generally indicated at 12. The guitar 12 is of the acoustical type having a neck portion 14 with a fingerboard 15, a body portion 16, and a plurality of strings 18 extending along the neck and body portions 14 and 16, respectively. The sensor assembly 10 is disposed beneath the strings 18 and mounted to the body portion 16 adjacent to or in the fingerboard 15 in a manner to be described. Although the sensor assembly 10 is illustrated with a guitar 12, it should be appreciated by those skilled in the art that any suitable type of stringed musical instrument may be enhanced by the sensor assembly 10. It should further be appreciated that the sensor assembly 10 may be used with either an electric type of stringed musical instrument 12.

The sensor assembly 10 may include a case (not shown) extending longitudinally and having a general "U" shape cross-section. The case has a generally planar base wall and a pair of generally planar side walls substantially parallel to each other and connected by generally arcuate shaped corner walls to the base wall to form a longitudinal channel. Preferably, the longitudinal channel has a lateral width greater than a height thereof. The case is fabricated from a single piece of ferromagnetic material such as an iron-based steel. The case may be secured by suitable means such as fasteners (not shown) to the fingerboard 15 as illustrated in FIG. 2.

Referring to FIGS. 2 through 6, the sensor assembly 10 includes a primary winding 26 made from a conductive material. Preferably, the primary winding 26 is made of a conductive material such as copper. The primary winding 26 is preferably a solid piece of copper made as a single layer stamping or multilaminate construction. It should be appreciated that the primary winding 26 may be made of any suitable conductive material.

The primary winding 26 has a configuration that acts as a one-turn receiver. In one embodiment, the primary winding 26 has a generally rectangular shape with a slot 27 extending therethrough. The primary winding 26 has a predetermined length. Preferably, the primary winding 26 extends to encompass all of the moveable strings 18. It should be appreciated that the primary winding 26 may be configured to have other suitable shapes other than the rectangular shape. It should also be appreciated that the primary winding 26 may be a plurality of windings.

The sensor assembly 10 also includes at least one, preferably a plurality of magnets 28 disposed adjacent the primary winding 26 to provide a magnetic flux field to the strings 18. The magnets 28 are secured to the interior surface of the case by suitable means such as an adhesive bonding agent. The magnets 28 are a permanent magnet strip and is made of a flexible permanent magnet material such as PLASTIFORM® which is commercially available from Arnold Engineering, Marango, Ill. The magnets 28 extend longitudinally and are generally rectangular in shape. It should be appreciated that the magnets 28 are orientated in a manner to be described.

The sensor assembly 10 also includes at least one, preferably a plurality of secondary windings 30 adjacent to the primary winding 26. In one embodiment, the secondary windings 30 extend generally perpendicular to the primary winding 26. The secondary windings 30 are coils of a conductive wire such as copper wrapped around core elements 32,34 to be described. It should be appreciated that the secondary windings 30 can be either single or multiple coils connected in series or parallel.

The secondary windings 30 are susceptible to electromagnetic flux transferred by the core elements 32 to be described from the primary winding 26. The secondary windings 30 transform the primary electromagnetic flux into a secondary current. More specifically, the primary winding 26 and the secondary windings 30 and the core elements 32,34 act together as a transformer which transforms the primary current into the secondary current. The secondary current is passed through an output port (not shown) to electronics subsequent to the sensor assembly 10. Although the primary winding 26 is shown to be a separate circuit than that of the secondary windings 30, the secondary windings 30 may in an alternative embodiment (not shown) be connected in series to the primary winding 26 at a common point to create an autotransformer. It should be appreciated that possible electronic components, which may be operatively connected to the output port include receivers, synthesizers, amplifiers, speakers, and the like.

The secondary windings 30 are shorter in length than the predetermined length of the primary winding 26. The secondary windings 30 include a first core element 32, which extends through one end of the secondary windings 30 and a second core element 34, which extends through the other end of the secondary windings 30. In one embodiment, the first and second core elements 32,34, which are "U" shaped in appearance, extend into the secondary windings 30 from each end and telescopingly engage. The core elements 32,34 are made from laminations of a high permeable magnetic material such as steel. It should be appreciated that the sensor assembly 10 may have a single secondary winding 30 as illustrated in FIG. 7 or multiple secondary windings 30 as illustrated in FIGS. 3 through 6 that can be combined in different ways to create a variety of tones. It should also be appreciated that the multiple secondary windings 30 may be in configured in a dual parallel arrangement as illustrated in FIG. 8 or with a potentiometer 36 as illustrated in FIG. 9. It should further be appreciated that the use of multiple secondary windings 30 provides flexibility in the tone and output of the sensor assembly 10. It should be still further appreciated that the multiple secondary windings 30 can be a variety of values and can be used with an elongated primary winding 26 to allow flexibility in the design and placement of the sensor assembly 10.

The sensor assembly 10 further includes a blade 40 extending through the slot 27 in the primary winding 26. The blade 40 acts as a core piece to conduct the magnetic field and to provide a flux connection to the strings 18. The blade 40 is fabricated from a ferromagnetic material such as cold rolled steel. The blade 40 is a thin plate made of steel or other such material that is susceptible to a magnetic field. The blade 40 includes a base end 42 and a distal end 44. The base end 42 is disposed adjacent the magnets 28 and may be fixedly secured to the magnets 28 via any suitable securing device, such as an adhesive epoxy. The distal end 44 is a sharp edge, which receives the movable strings 18 thereon. The distal end 44 is curvilinear allowing it to blend in with the curvature of the fingerboard 15 and apply equal flux on each of the movable strings 18 so that each of the movable strings 18 affects the magnetic field from the blade 40 equally. It should be appreciated by those skilled in the art that the curvilinear shape of the distal end 44 might vary depending on the type of stringed musical instrument 12 used. It should also be appreciated by those skilled in the art that the distal end 44 may even be straight for such instruments as acoustic violins, banjos, ukuleles, and the like wherein the strings all are set in a single plane.

Referring to FIGS. 10 through 12, another embodiment, according to the present invention, of the sensor assembly 10 is shown. Like parts of the sensor assembly 10 have like reference numerals increased by one hundred (100). In this embodiment, the sensor assembly 110 includes a case or cover 150 extending longitudinally and having a general "U" shape cross-section. The cover 150 has a generally planar base wall 152 and a pair of generally planar side walls 154 substantially parallel to each other and connected by generally arcuate shaped corner walls 156 to the base wall to form a longitudinal channel 158. Preferably, the longitudinal channel 158 has a lateral width greater than a height thereof. The cover 150 has a flange 160 extending outwardly at each corner wall 156 and generally perpendicular thereto. The flange 160 has an aperture 162 extending therethrough to allow a fastener (not shown) to extend through the aperture 162 and slot 127 of the primary winding 126 and secure the cover 150 to the body portion 16 of the stringed musical instrument 12. The cover 150 is fabricated from a single piece of material such as plastic or an iron based steel and forms a cup to contain the magnets 128, primary winding 126, and blade 140.

The sensor assembly 110 also has a case 164 for the secondary windings 130. The case 164 is disposed about the secondary windings 130 and secured thereto by suitable means. The core piece 132 may have a projection 166 to extend through the slot 127 to secure the secondary winding 130 to the primary winding 126. It should also be appreciated that the primary winding 126 may have a portion disposed below a plane of a remainder thereof to which the secondary windings 130 are attached.

Referring to FIGS. 13 through 17, yet another embodiment, according to the present invention, of the sensor assembly 10 is shown. Like parts of the sensor assembly 10 have like reference numerals increased by two hundred (200). In this embodiment, the sensor assembly 210 includes a primary winding 226 having a configuration that acts as a one-turn receiver. In this embodiment, the primary winding 226 has a base 226*a* extending transversely to encompass all of the moveable strings 18. The primary winding 226 also has a first end 226*b* extending generally perpendicular to the base 226*a* and a second end 226*c* extending generally perpendicular to the base 226*a*. The second end 226*c* has a generally "J" shape for a function to be described. The primary winding 226 is made from a non-ferrous, conductive material. Preferably, the primary winding 26 is made of a conductive material such as copper. It should be appreciated that the first end 226*b* and second end 226*c* do not contact each other and that the primary winding 226 is not a closed loop, but an open loop.

The sensor assembly 210 also includes at least one, preferably a plurality of magnets 228 disposed adjacent the primary winding 226 to provide a magnetic flux field to the strings 18. The magnets 228 are secured between and to a pair of blades to be described by suitable means such as an adhesive bonding agent. The magnets 228 are made of a permanent magnet material such as Neodymium, which is commercially available. The magnets 228 are spaced longitudinally and are generally circular in shape. It should be appreciated that the magnets 228 are orientated in a manner to be described. It should also be appreciated that the magnets 228 may be made of other types of magnetic material.

The sensor assembly 210 also includes at least one, preferably a plurality of secondary windings 230 adjacent to the primary winding 226. In one embodiment, the secondary windings 230 extend generally perpendicular to the primary winding 226. The secondary windings 230 are coils of a conductive wire such as copper wrapped around core elements 232,234.

The secondary windings 230 are susceptible to electromagnetic flux transferred by the core elements 232 from the primary winding 226. The secondary windings 230 transform the primary electromagnetic flux into a secondary current. More specifically, the primary winding 226 and the secondary windings 230 and the core elements 232,234 act together as a transformer which transforms the primary current into the secondary current. The secondary current is passed through an output port (not shown) to electronics subsequent to the sensor assembly 210. It should be appreciated that possible electronic components, which may be operatively connected to the output port include receivers, synthesizers, amplifiers, speakers, and the like.

Figure 14:
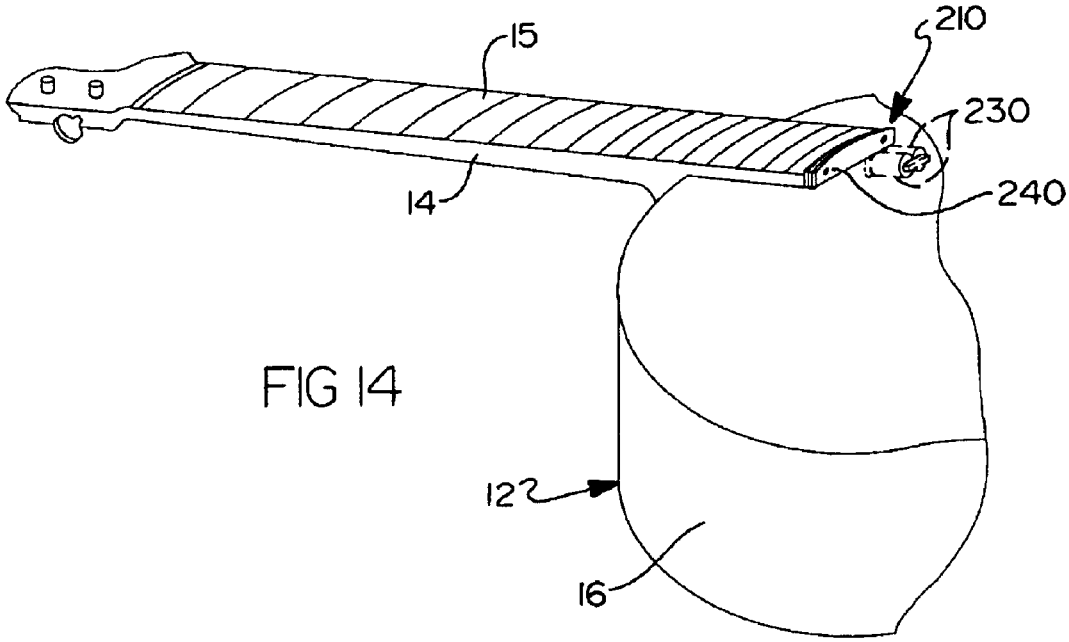
FIG. 14 is a partial perspective view of the sensor assembly and stringed musical instrument of FIG. 13 illustrated with the strings removed.

The secondary windings 230 are shorter in length than the predetermined length of the primary winding 226. The secondary windings 230 include a first core element 232, which extends through one end of the secondary windings 230 and a second core element 234, which extends through the other end of the secondary windings 230. In one embodiment, the first and second core elements 232,234, which are "U" shaped in appearance, extend into the secondary windings 230 from each end and telescopingly engage. Each of the core elements 232,234 is made from a plurality of laminations, preferably four, of a high permeable magnetic material such as steel. It should be appreciated that the sensor assembly 210 has a pair of secondary windings 230 that act as dual humbucking secondaries. It should also be appreciated that the secondary windings 230 may be spaced farther from the primary winding 226 as illustrated in FIG. 14.

The sensor assembly 210 further includes a plurality, preferably a pair, of blades 240 disposed on the sides of the primary winding 226 such that the primary winding 226 is disposed therebetween. The blades 240 act as a core piece to conduct the magnetic field and to provide a flux connection to the strings 18. The blades 240 are fabricated from a ferromagnetic material such as cold rolled steel. The blades 240 are a thin plate made of steel or other such material that is susceptible to a magnetic field. The blade 240 includes at least one, preferably a plurality of apertures 260 extending therethrough for a function to be described. One of the blades 240 is disposed adjacent the magnets 28 and the blade 240 may be fixedly secured to the magnets 28 via any suitable securing device, such as an adhesive epoxy. The other one of the blades 240 has an inner surface 261 that is electrically insulated from the magnets 228. That blade 240 disposed on one side of the primary winding 226 and the other blade 240 is disposed on the other side of the primary winding 226 and the primary winding 226 and blades 240 are electrically secured together by suitable means such as soldering at a plurality of locations 262. The blades 240 have a distal end 244 that is curvilinear allowing it to blend in with the curvature of the fingerboard 15 and apply equal flux on each of the movable strings 18 so that each of the movable strings 18 affects the magnetic field from the blades 240 equally. It should be appreciated by those skilled in the art that the curvilinear shape of the distal end 244 might vary depending on the type of stringed musical instrument 12 used. It should also be appreciated by those skilled in the art that the distal end 244 may even be straight for such instruments as acoustic violins, banjos, ukuleles, and the like wherein the strings all are set in a single plane. It should further be appreciated that one of the blades 240 is magnetic north and the other blade is magnetic south. It should still further be appreciated that the sensor assembly 210 may be mounted to the end of the neck 14 by suitable means such as fasteners (not shown) extending through the apertures 260 in the blades 240 and into the neck 14.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A sensor assembly for a stringed musical instrument having a plurality of movable strings comprising:

at least one blade adapted to be disposed below the movable strings and adapted to be either one of disposed at an end of a neck and disposed in the neck of the stringed musical instrument;

at least one magnet disposed adjacent said at least one blade to generate a magnetic field through said at least one blade;

a primary winding disposed adjacent said at least one blade to create a primary current from a disruption in the magnetic field by the movable strings, the primary current creating a primary electromagnetic flux; and at least one secondary winding spaced from said primary winding and being magnetically coupled to said primary winding, said at least one secondary winding transforming the primary electromagnetic flux into a secondary current adapted to pass out the stringed musical instrument.

2. A sensor assembly as set forth in claim 1 wherein said at least one blade extends through a slot in said primary winding.

3. A sensor assembly as set forth in claim 1 wherein said at least one blade is a thin plate fabricated from a ferromagnetic material that is susceptible to a magnetic field.

4. A sensor assembly as set forth in claim 1 wherein said at least one blade is fabricated from cold-rolled steel.

5. A sensor assembly as set forth in claim 1 wherein said at least one blade is electrically connected to one side of said primary winding.

6. A sensor assembly as set forth in claim 1 including a plurality of blades, said primary winding being disposed between said blades and electrically connected thereto.

7. A sensor assembly as set forth in claim 1 wherein said blade includes a base end and a distal end, said base end being disposed adjacent said at least one magnet and said distal end being disposed adjacent the movable strings.

8. A sensor assembly as set forth in claim 7 wherein said base is fixedly secured to said at least one magnet.

9. A sensor assembly as set forth in claim 7 wherein said distal end is curvilinear.

10. A sensor assembly as set forth in claim 1 wherein said primary winding is a closed loop.

11. A sensor assembly as set forth in claim 1 wherein said primary winding is an open loop.

12. A sensor assembly as set forth in claim 1 wherein said primary winding has a generally rectangular shape of a pre-determined length and a slot extending through said primary winding through which said at least one blade extends.

13. A sensor assembly as set forth in claim 1 wherein said at least one magnet includes a plurality of magnets.

14. A sensor assembly as set forth in claim 1 wherein said at least one magnet is generally rectangular and extends substantially longitudinally.

15. A sensor assembly as set forth in claim 1 wherein said at least one magnet is generally circular in shape.

16. A sensor assembly for a stringed musical instrument having a plurality of movable strings comprising:

at least one blade adapted to be disposed adjacent the movable strings;

at least one magnet disposed adjacent said at least one blade to generate a magnetic field through said at least one blade;

a primary winding disposed adjacent said at least one blade to create a primary current from a disruption in the magnetic field by the movable strings, the primary current creating a primary electromagnetic flux;

at least one secondary winding spaced from said primary winding and being magnetically coupled to said primary winding, said at least one secondary winding transforming the primary electromagnetic flux into a secondary current adapted to pass out the stringed musical instrument; and a first core element extending through one end of said at least one secondary winding and a second core element extending through the other end of said at least one secondary winding, said first and second core elements adapted to receive the electromagnetic flux from said primary winding and transform the electromagnetic flux into the secondary current.

17. A sensor assembly for a stringed musical instrument having a plurality of movable strings comprising:

at least one blade adapted to be disposed adjacent the movable strings;

at least one magnet disposed adjacent said at least one blade to generate a magnetic field through said at least one blade;

a primary winding disposed adjacent said at least one blade to create a primary current from a disruption in the magnetic field by the movable strings, the primary current creating a primary electromagnetic flux;

at least one secondary winding spaced from said primary winding and being magnetically coupled to said primary winding, said at least one secondary winding transforming the primary electromagnetic flux into a secondary current adapted to pass out the stringed musical instrument;

a first core element extending through one end of said at least one secondary winding and a second core element extending through the other end of said at least one secondary winding; and wherein said first and second core elements are substantially "U" shaped and are adapted to telescopingly engage each other.

18. A sensor assembly for a stringed musical instrument having a plurality of movable strings comprising:

a blade disposed adjacent the plurality of movable strings and adapted to provide a flux connection to the plurality of movable strings;

at least one magnet adapted to generate a magnetic field through and conducted by said blade, the plurality of movable strings adapted to disrupt the magnetic field;

a primary winding disposed adjacent said at least one magnet and adapted to create a primary current from a disruption in the magnetic field by the plurality of movable strings, the primary current creating a primary electromagnetic flux;

at least one secondary winding spaced from and magnetically coupled by a plurality of high magnetic permeability metal laminate core elements to said primary winding, said at least one secondary winding adapted to transform the primary electromagnetic flux into a secondary current adapted to pass out the instrument;

a case that extends longitudinally, has a generally "U" shaped cross-section defining a substantially longitudinal channel, defines an interior surface of said case, and is fabricated from a single piece of ferromagnetic material and adapted to secure said at least one magnet to said interior surface; and a cover disposed about and secured to said at least one secondary winding.

19. A sensor assembly for a stringed musical instrument having a plurality of movable strings comprising:

a plurality of blades adapted to be disposed below the movable strings and adapted to be either one of disposed at an end of a neck and disposed in the neck of the stringed musical instrument;

a plurality of magnets disposed between said blade to generate a magnetic field though said blades;

a primary winding disposed between said blades and electrically connected thereto to create a primary current from a disruption in the magnetic field by the movable strings, the primary current creating a primary electromagnetic flux; and a plurality of secondary winding spaced from said primary winding and being magnetically coupled to said primary winding, said secondary windings transforming said primary electromagnetic flux into a secondary current adapted to pass out the stringed musical instrument.

* * * * *